US010540893B2

(12) United States Patent
Hori et al.

(10) Patent No.: US 10,540,893 B2
(45) Date of Patent: Jan. 21, 2020

(54) INFORMATION PROCESSOR AND VEHICLE SYSTEM

(71) Applicant: TOYOTA JIDOSHA KABUSHIKI KAISHA, Toyota-shi, Aichi-ken (JP)

(72) Inventors: Takashige Hori, Aisai (JP); Makoto Akahane, Nagoya (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/156,475

(22) Filed: Oct. 10, 2018

(65) Prior Publication Data

US 2019/0114913 A1 Apr. 18, 2019

(30) Foreign Application Priority Data

Oct. 12, 2017 (JP) ..... 2017-198648

(51) Int. Cl.
*G08G 1/16* (2006.01)
*G08G 1/0967* (2006.01)
*G08G 1/01* (2006.01)

(52) U.S. Cl.
CPC ..... *G08G 1/096775* (2013.01); *G08G 1/0133* (2013.01)

(58) Field of Classification Search
CPC ..... G08G 1/096775; G08G 1/0133
See application file for complete search history.

(56) References Cited

U.S. PATENT DOCUMENTS

2016/0071417 A1* 3/2016 Lewis ..... G08G 1/162 701/301
2016/0185347 A1* 6/2016 Lefevre ..... B60W 30/09 701/301
2017/0256166 A1* 9/2017 Nishiyama ..... G08G 1/09626

FOREIGN PATENT DOCUMENTS

JP 2009-151701 A 7/2009
JP 2014-191577 A 10/2014

* cited by examiner

*Primary Examiner* — Munear T Akki
(74) *Attorney, Agent, or Firm* — Hunton Andrews Kurth LLP

(57) ABSTRACT

In an information processor, a first acquirer acquires, when a first vehicle is traveling on a first road toward an intersection and a second vehicle is traveling on a second road, which intersects the first road, toward the intersection, a traveling tendency of the first vehicle from a first storage unit storing the traveling tendency at an intersection of each of multiple vehicles. A second acquirer acquires, when the first vehicle is traveling on the first road toward the intersection and the second vehicle is traveling on the second road toward the intersection, riskiness of the intersection from a second storage unit storing the riskiness of each of multiple intersections. Based on the traveling tendency of the first vehicle and the riskiness of the intersection, a judgment unit judges whether or not there is caution information at the time of passing through the intersection.

6 Claims, 5 Drawing Sheets

INFORMATION PROCESSOR AND VEHICLE SYSTEM

The disclosure of Japanese Patent Application No. 2017-198648 filed on Oct. 12, 2017 including the specification, drawings and abstract is incorporated herein by reference in its entirety.

BACKGROUND

1. Technical Field

The present disclosure relates to an information processor and a vehicle system configured to notify a vehicle driver of information.

2. Description of Related Art

A technology is known by which, at an intersection, when a vehicle should stop for a stop signal of a traffic light but is traveling at a predetermined speed or higher, the display of a traffic light on an intersecting road, which intersects the road on which the vehicle is travelling, is changed, so that a person in a vehicle traveling on the intersecting road is notified of the vehicle ignoring the stop signal to enter the intersection (see JP-A-2009-151701, for example).

With the abovementioned technology, however, an accident prevention system needs to be installed for each intersection at which the existence of a dangerous vehicle needs to be announced. Accordingly, it is not realistic to announce the existence of a dangerous vehicle at an arbitrary intersection.

SUMMARY

The embodiments address the above-described issue, and a general purpose thereof is to provide an information processor and a vehicle system capable of performing, at an arbitrary intersection, notification of accurate caution information at the time of passing through the intersection.

To resolve the issue above, an information processor of one embodiment includes: a first acquirer configured to acquire, when a first vehicle is traveling on a first road toward an intersection and a second vehicle is traveling on a second road, which intersects the first road, toward the intersection, a traveling tendency of the first vehicle from a first storage unit storing the traveling tendency at an intersection of each of a plurality of vehicles; a second acquirer configured to acquire, when the first vehicle is traveling on the first road toward the intersection and the second vehicle is traveling on the second road toward the intersection, riskiness of the intersection from a second storage unit storing the riskiness of each of a plurality of intersections; a judgment unit configured to judge whether or not there is caution information at the time of passing through the intersection, based on the traveling tendency of the first vehicle acquired by the first acquirer and the riskiness of the intersection acquired by the second acquirer; and a notification unit configured to notify, when the judgment unit has judged that there is caution information at the time of passing through the intersection, the second vehicle of the caution information at the time of passing through the intersection, before the second vehicle enters the intersection.

According to the embodiment, when the first vehicle is traveling on the first road toward the intersection and the second vehicle is traveling on the second road toward the intersection, the traveling tendency of the first vehicle is acquired from the first storage unit, and the riskiness of the intersection is acquired from the second storage unit. Based on the traveling tendency of the first vehicle and the riskiness of the intersection, whether or not there is caution information at the time of passing through the intersection is judged, and, when it is judged that there is caution information at the time of passing through the intersection, the second vehicle is notified of the caution information at the time of passing through the intersection. Therefore, accurate caution information at the time of passing through the intersection can be conveyed at an arbitrary intersection.

The information processor may further include: a third acquirer configured to acquire vehicle information at the time of entering an intersection of each of a plurality of vehicles; a first deriver configured to derive the traveling tendency at an intersection of each vehicle based on the vehicle information of each of a plurality of vehicles acquired by the third acquirer and to store the traveling tendency thus derived in the first storage unit; and a second deriver configured to derive the riskiness of each intersection based on the vehicle information of each of a plurality of vehicles acquired by the third acquirer and to store the riskiness thus derived in the second storage unit.

The judgment unit may judge the riskiness at the time of entering the intersection, as the caution information at the time of passing through the intersection.

When the traveling tendency of the first vehicle indicates a tendency to contravene the traffic regulations, the judgment unit may judge the riskiness at the time of entering the intersection to be higher, and, when the riskiness of the intersection is higher, the judgment unit may also judge the riskiness at the time of entering the intersection to be higher.

The first road may be a road with a stop instruction, and the second road may be a priority road.

Another embodiment relates to a vehicle system. The vehicle system includes: a first storage unit storing a traveling tendency at an intersection of each of a plurality of vehicles; a second storage unit storing riskiness of each of a plurality of intersections; a first acquirer configured to acquire, when a first vehicle is traveling on a first road toward an intersection and a second vehicle is traveling on a second road, which intersects the first road, toward the intersection, the traveling tendency of the first vehicle from the first storage unit; a second acquirer configured to acquire, when the first vehicle is traveling on the first road toward the intersection and the second vehicle is traveling on the second road toward the intersection, the riskiness of the intersection from the second storage unit; a judgment unit configured to judge whether or not there is caution information at the time of passing through the intersection, based on the traveling tendency of the first vehicle acquired by the first acquirer and the riskiness of the intersection acquired by the second acquirer; and a notification unit configured to notify, when the judgment unit has judged that there is caution information at the time of passing through the intersection, the second vehicle of the caution information at the time of passing through the intersection, before the second vehicle enters the intersection.

BRIEF DESCRIPTION OF THE DRAWINGS

Embodiments will now be described, by way of example only, with reference to the accompanying drawings that are meant to be exemplary, not limiting, and wherein like elements are numbered alike in several figures, in which.

DETAILED DESCRIPTION

Various embodiments now will be described. The embodiments are illustrative and are not intended to be limiting.

First Embodiment

Figure 1:
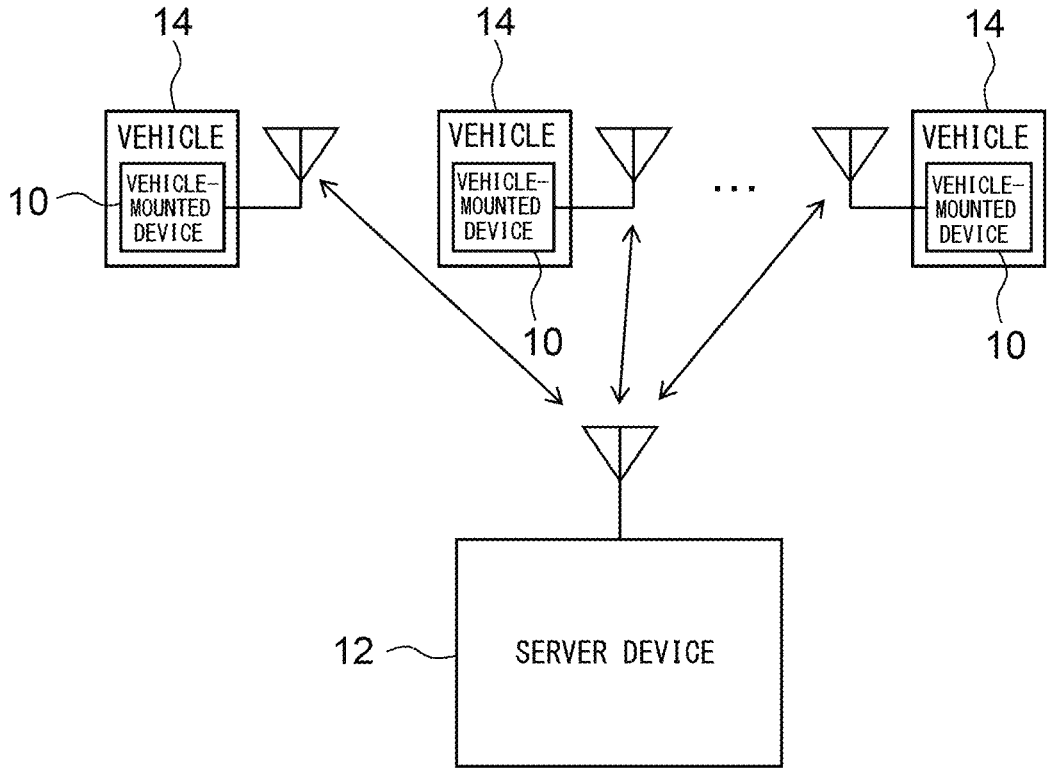
FIG. 1 is a block diagram that shows a configuration of a vehicle system according to a first embodiment.

FIG. 1 is a block diagram that shows a configuration of a vehicle system 1 according to the first embodiment. The vehicle system 1 comprises multiple vehicle-mounted devices 10 and a server device 12. FIG. 1 shows three vehicle-mounted devices 10 among the multiple vehicle-mounted devices 10.

Each vehicle-mounted device 10 is mounted on a vehicle 14, which is an automobile. Each vehicle-mounted device 10 performs wireless communication with the server device 12. The wireless communication standard is not particularly limited, and may be 3G (third-generation mobile communication system), 4G (fourth-generation mobile communication system), or 5G (fifth-generation mobile communication system), for example. Each vehicle-mounted device 10 may perform wireless communication with the server device 12 via a base station, which is not illustrated. The server device 12 may be installed in a data center, for example, and functions as an information processor for processing big data transmitted from the multiple vehicle-mounted devices 10.

Figure 2:
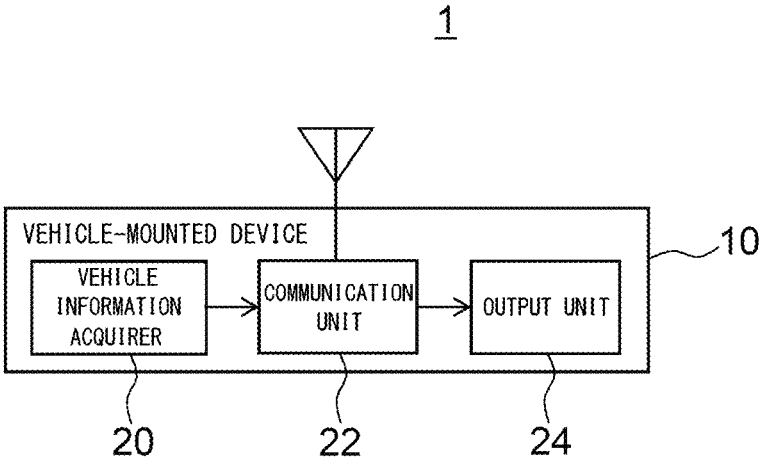
FIG. 2 is a block diagram that shows a configuration of a vehicle-mounted device shown in FIG. 1.

FIG. 2 is a block diagram that shows a configuration of a vehicle-mounted device 10 shown in FIG. 1. The vehicle-mounted device 10 comprises a vehicle information acquirer 20, a communication unit 22, and an output unit 24. The vehicle information acquirer 20 regularly acquires vehicle information of the subject vehicle, on which the vehicle-mounted device 10 is mounted, and outputs the vehicle information to the communication unit 22. The vehicle information may include position information of the subject vehicle, bearing information indicating the traveling direction of the subject vehicle, speed information of the subject vehicle, deceleration information of the subject vehicle, and brake operation amount information of the subject vehicle, for example. The position information may be acquired from a GPS receiver, not illustrated, for example. The bearing information, speed information, deceleration information, and brake operation amount information may be acquired from various sensors, not illustrated, for example. The frequency of acquiring the vehicle information can be appropriately determined through experiments or the likes, and may be several times to several tens of times per second, for example. The frequency of acquiring the vehicle information may be different for each type of vehicle information.

The communication unit 22 performs wireless communication with the server device 12. The communication unit 22 regularly transmits, to the server device 12, vehicle information acquired by the vehicle information acquirer 20. To the vehicle information, information for identifying the vehicle 14 as the transmission source is attached. The frequency of transmitting the vehicle information can be appropriately determined through experiments or the likes, and may be the same as the frequency at which the vehicle information acquirer 20 acquires the vehicle information, for example.

When caution information at the time of passing through an intersection is transmitted from the server device 12 to the subject vehicle, the communication unit 22 receives the caution information at the time of passing through the intersection. The output unit 24 then provides, to the driver, the caution information at the time of passing through the intersection thus received by the communication unit 22. The communication unit 22 and the output unit 24 will be detailed later.

Figure 3:
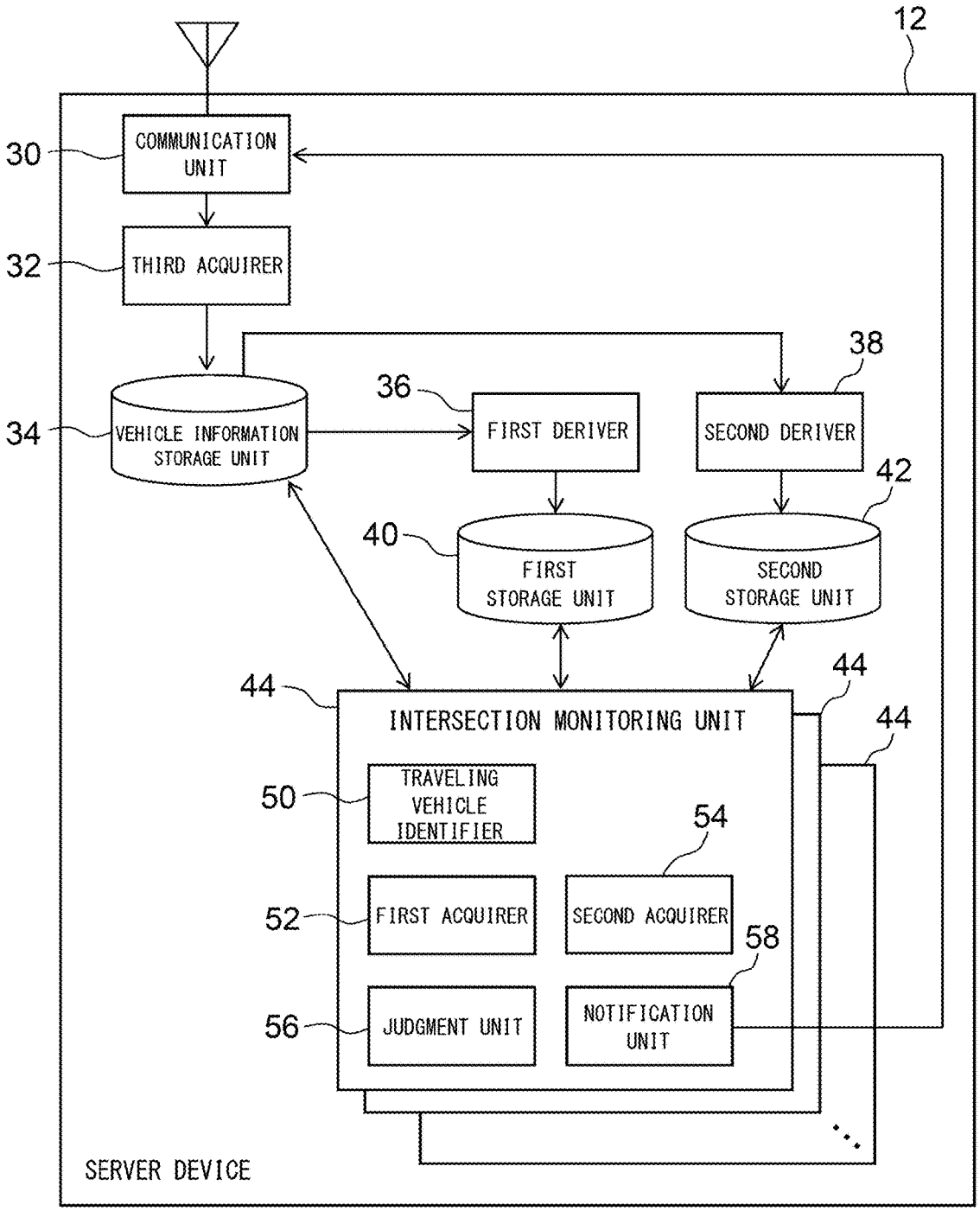
FIG. 3 is a block diagram that shows a configuration of a server device shown in FIG. 1.

FIG. 3 is a block diagram that shows a configuration of the server device 12 shown in FIG. 1. The server device 12 comprises a communication unit 30, a third acquirer 32, a vehicle information storage unit 34, a first deriver 36, a second deriver 38, a first storage unit 40, a second storage unit 42, and multiple intersection monitoring units 44.

The communication unit 30 performs wireless communication with the communication unit 22 of each of the multiple vehicle-mounted devices 10. The communication unit 30 receives vehicle information of multiple vehicles 14 from the communication units 22 of the multiple vehicle-mounted devices 10. The vehicle information includes vehicle information at the time of entering an intersection. The communication unit 30 outputs the vehicle information of the multiple vehicles 14 to the third acquirer 32.

The third acquirer 32 acquires the vehicle information of the multiple vehicles 14 received by the communication unit 30. The third acquirer 32 then outputs the vehicle information of the multiple vehicles 14 to the vehicle information storage unit 34. Accordingly, the vehicle information storage unit 34 stores the vehicle information of the multiple vehicles 14 acquired by the third acquirer 32.

Based on the vehicle information of the multiple vehicles 14 stored in the vehicle information storage unit 34, the first deriver 36 regularly derives the traveling tendency at an intersection of each vehicle 14 and stores the traveling tendency thus derived in the first storage unit 40. Namely, the traveling tendency at an intersection is specific to each vehicle 14 and is regularly updated. The frequency of deriving the traveling tendency at an intersection can be appropriately determined through experiments or the likes. The first storage unit 40 stores the traveling tendency at an intersection of each of the multiple vehicles 14.

The traveling tendency at an intersection of each vehicle 14 indicates whether or not the driver of the vehicle 14 tends to contravene the traffic regulations at an intersection. More specifically, the traveling tendency at an intersection of each vehicle 14 indicates whether the driver tends not to stop or tends to stop late at an intersection with a stop instruction. The stop instruction includes a red signal, a stop sign, and a stop line, for example. The position of the stop instruction can be identified based on map data stored in a storage unit, which is not illustrated.

The traveling tendency at an intersection of each vehicle 14 can be expressed as a numerical value, for example. In the following, an example will be described in which, when the numerical value indicating the traveling tendency at an intersection of a vehicle 14 is larger, the driver of the vehicle 14 is more likely to contravene the traffic regulations at an intersection, and is more likely not to stop or more likely to stop late at a stop instruction. As the ratio of the number of times a vehicle 14 has not stopped or has stopped late at a stop instruction to the number of times the vehicle 14 has passed through an intersection becomes larger, the numerical value indicating the traveling tendency at an intersection of the vehicle 14 also becomes larger.

When a vehicle 14 travels on a road with a stop instruction and when the speed of the vehicle 14 passing through an intersection is a first threshold or higher, the first deriver 36 judges that the vehicle 14 has not stopped at the stop instruction, so as to increase the numerical value indicating the traveling tendency at an intersection of the vehicle 14. When the speed of the vehicle 14 passing through the intersection is less than the first threshold, the first deriver 36 judges that the vehicle 14 has stopped at the stop instruction.

When a vehicle 14 travels on a road with a stop instruction and when the degree of deceleration of the vehicle 14 entering an intersection is a second threshold or greater and, in addition, the brake operation amount of the vehicle 14 entering the intersection is a third threshold or greater, the first deriver 36 judges that the vehicle 14 has stopped late at the stop instruction, so as to increase the numerical value indicating the traveling tendency at an intersection of the vehicle 14. When the degree of deceleration is less than the second threshold or when the brake operation amount is less than the third threshold, the first deriver 36 judges that the vehicle 14 has appropriately stopped at the stop instruction. The optimum value of each of the first threshold, second threshold, and third threshold can be appropriately determined through experiments or the likes.

The first deriver 36 may set the amount by which the numerical value indicating the traveling tendency at an intersection is increased when it is judged that the vehicle 14 has not stopped, to be greater than the amount by which the numerical value indicating the traveling tendency at an intersection is increased when it is judged that the vehicle 14 has stopped late.

Based on the vehicle information of the multiple vehicles 14 stored in the vehicle information storage unit 34, the second deriver 38 regularly derives the riskiness of each intersection and stores the riskiness thus derived in the second storage unit 42. Namely, the riskiness is specific to each intersection and is regularly updated. The second storage unit 42 stores the riskiness of each of multiple intersections.

The riskiness of each intersection may be expressed as a numerical value, for example, and is the sum of first riskiness and second riskiness. The first riskiness indicates how many vehicles 14 have not stopped or have stopped late at a stop instruction at the intersection. For example, if drivers cannot visually recognize a stop instruction easily at an intersection, the first riskiness of the intersection will be higher.

When a vehicle 14 travels on a road with a stop instruction and when the speed of the vehicle 14 passing through an intersection is the first threshold or higher, the second deriver 38 judges that the vehicle 14 has not stopped at the stop instruction, so as to increase the first riskiness of the intersection. When the speed of the vehicle 14 passing through the intersection is less than the first threshold, the second deriver 38 judges that the vehicle 14 has stopped at the stop instruction.

When a vehicle 14 travels on a road with a stop instruction and when the degree of deceleration of the vehicle 14 entering an intersection is the second threshold or greater and, in addition, the brake operation amount of the vehicle 14 entering the intersection is the third threshold or greater, the second deriver 38 judges that the vehicle 14 has stopped late at the stop instruction, so as to increase the first riskiness of the intersection. When the degree of deceleration is less than the second threshold or when the brake operation amount is less than the third threshold, the second deriver 38 judges that the vehicle 14 has appropriately stopped at the stop instruction.

The second deriver 38 may set the amount by which the first riskiness is increased when it is judged that the vehicle 14 has not stopped, to be greater than the amount by which the first riskiness is increased when it is judged that the vehicle 14 has stopped late.

The second riskiness indicates the poorness of visibility at the intersection, and, if the visibility from one road toward another road is poor at an intersection because of an obstacle, such as a building and a wall, located near the intersection, the second riskiness of the intersection will be higher. The second riskiness is a fixed value preset for each intersection and is stored in the second storage unit 42 in advance. The second riskiness may be updated with some frequency, such as once a year. Also, the second riskiness needs not necessarily be used.

Figure 4:
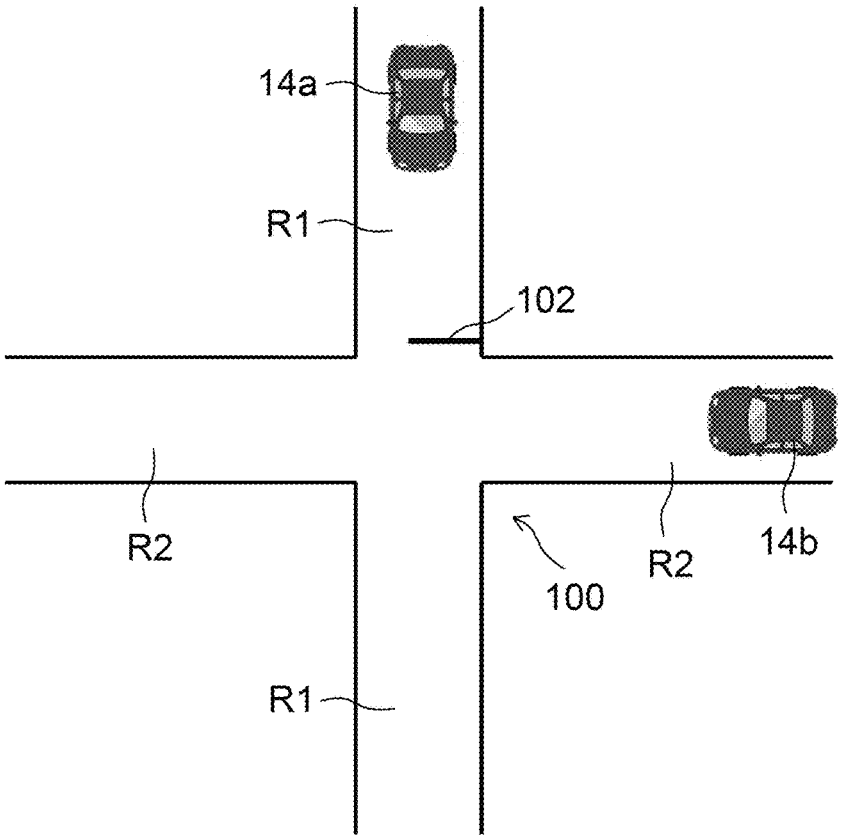
FIG. 4 shows an example of an intersection monitored by an intersection monitoring unit shown in FIG. 3.

The multiple intersection monitoring units 44 respectively monitor predetermined intersections. Each of the multiple intersection monitoring units 44 has the same functions except monitoring a different intersection. In the following, an intersection monitoring unit 44 monitoring an intersection 100 shown in FIG. 4 will be described with reference to FIG. 4. FIG. 4 shows an example of the intersection 100 monitored by an intersection monitoring unit 44 shown in FIG. 3. At the intersection 100, a first road R1 and a second road R2 intersect. The first road R1 is a road with a stop line 102 as a stop instruction provided before the intersection 100, and the second road R2 is a priority road with no stop line.

The intersection monitoring unit 44 comprises a traveling vehicle identifier 50, a first acquirer 52, a second acquirer 54, a judgment unit 56, and a notification unit 58. The traveling vehicle identifier 50 acquires, from the vehicle information storage unit 34, current position information and current bearing information of each vehicle present near the predetermined intersection 100. The vehicle information thus acquired includes information of a first vehicle 14*a* and a second vehicle 14*b* traveling toward the intersection 100, and may also include information of a vehicle that has passed through the intersection 100. Based on map data and the acquired current position and traveling direction of each vehicle present near the predetermined intersection 100, the traveling vehicle identifier 50 identifies the first vehicle 14*a* traveling on the first road R1 with a stop instruction toward the intersection 100, and the second vehicle 14*b* traveling on the second road R2 as a priority road toward the intersection 100. The traveling vehicle identifier 50 then notifies the first acquirer 52 and the second acquirer 54 of the identification of the first vehicle 14*a* and the second vehicle 14*b*. In this example, the vehicle-mounted device 10 is mounted on each of the first vehicle 14*a* and the second vehicle 14*b*.

When the first vehicle 14*a* is traveling on the first road R1 toward the intersection 100 and the second vehicle 14*b* is traveling on the second road R2 toward the intersection 100, the first acquirer 52 acquires the traveling tendency of the first vehicle 14*a* from the first storage unit 40. The first acquirer 52 then outputs the traveling tendency of the first vehicle 14*a* to the judgment unit 56.

When the first vehicle 14*a* is traveling on the first road R1 toward the intersection 100 and the second vehicle 14*b* is traveling on the second road R2 toward the intersection 100, the second acquirer 54 acquires the riskiness of the intersection 100 from the second storage unit 42. The second acquirer 54 then outputs the riskiness of the intersection 100 to the judgment unit 56.

Based on the traveling tendency of the first vehicle 14*a* acquired by the first acquirer 52 and the riskiness of the intersection 100 acquired by the second acquirer 54, the judgment unit 56 judges whether or not there is caution information at the time of passing through the intersection.

For example, the judgment unit 56 may judge whether or not there is caution information at the time of passing through the intersection, based on an evaluation value calculated by substituting the numerical value indicating the traveling tendency of the first vehicle 14*a* and the riskiness of the intersection 100 into a predetermined calculation formula. The predetermined calculation formula may be a calculation formula for calculating as the evaluation value the sum of the numerical value indicating the traveling tendency of the first vehicle 14*a* and the riskiness of the intersection 100, a calculation formula for calculating as the evaluation value the product of the numerical value indicating the traveling tendency of the first vehicle 14*a* and the riskiness of the intersection 100, or another calculation formula. When the evaluation value is a judgment threshold or greater, the judgment unit 56 judges that there is caution information at the time of passing through the intersection, and, when the evaluation value is less than the judgment threshold, the judgment unit 56 judges that there is no caution information at the time of passing through the intersection. The optimum value of the judgment threshold can be appropriately determined through experiments or the likes.

The judgment unit 56 may retain a table containing correspondence relationships between the traveling tendency of the first vehicle 14*a*, the riskiness of the intersection 100, and whether or not there is caution information, and may refer to the table to judge whether or not there is caution information at the time of passing through the intersection.

The judgment unit 56 may judge the riskiness at the time of entering the intersection, as the caution information at the time of passing through the intersection. In this case, the judgment unit 56 may use the aforementioned evaluation value, as the riskiness at the time of entering the intersection. Namely, when the traveling tendency of the first vehicle 14*a* indicates a tendency to contravene the traffic regulations, the judgment unit 56 judges the riskiness at the time of entering the intersection to be higher, and, when the riskiness of the intersection 100 is higher, the judgment unit 56 also judges the riskiness at the time of entering the intersection to be higher.

For example, when the numerical value indicating the traveling tendency of the first vehicle 14*a* is large and the first vehicle 14*a* is highly likely to contravene the traffic regulations at an intersection, the judgment unit 56 judges the riskiness at the time of entering the intersection to be high, even if the riskiness of the intersection 100 is low. Also, when the riskiness of the intersection 100 is high, the judgment unit 56 judges the riskiness at the time of entering the intersection to be high, even if the numerical value indicating the traveling tendency of the first vehicle 14*a* is small and the first vehicle 14*a* is less likely to contravene the traffic regulations at an intersection.

The judgment unit 56 outputs the judgment result to the notification unit 58. When the judgment unit 56 has judged that there is caution information at the time of passing through the intersection, the notification unit 58 notifies, via the communication unit 30, the second vehicle 14*b* of the caution information at the time of passing through the intersection, before the second vehicle 14*b* enters the intersection 100. More specifically, the notification unit 58 outputs the caution information at the time of passing through the intersection to the communication unit 30. The communication unit 30 then transmits the caution information at the time of passing through the intersection to the second vehicle 14*b*. To the caution information at the time of passing through the intersection, information for identifying the second vehicle 14*b* as the transmission destination is attached.

Referring back to FIG. 2, the communication unit 22 of the vehicle-mounted device 10 on the second vehicle 14*b* receives the caution information at the time of passing through the intersection transmitted from the communication unit 30 of the server device 12. The communication unit 22 provides the caution information at the time of passing through the intersection to the output unit 24. Accordingly, the output unit 24 provides to the driver the caution information at the time of passing through the intersection provided by the communication unit 22, before the second vehicle 14*b* enters the intersection 100. The output unit 24 may be configured as a display unit that displays the caution information at the time of passing through the intersection in the form of text and images, as a speaker or the like that outputs the caution information at the time of passing through the intersection in the form of sound, or as a combination thereof. When the riskiness at the time of entering the intersection is judged as the caution information at the time of passing through the intersection, the output unit 24 outputs the riskiness at the time of entering the intersection. When the riskiness at the time of entering the intersection is higher, the output unit 24 may display text and images with more distinctive colors or sizes, or may output sound drawing the driver's attention more strongly.

When the vehicle-mounted device 10 is not mounted on the first vehicle 14*a*, the traveling vehicle identifier 50 is unable to identify the first vehicle 14*a*, and the first acquirer 52 is unable to acquire the traveling tendency of the first vehicle 14*a*. Even in this case, the judgment unit 56 judges whether or not there is caution information at the time of passing through the intersection, based on the riskiness of the intersection 100 acquired by the second acquirer 54. When the riskiness of the intersection 100 is higher, the judgment unit 56 judges that there is caution information at the time of passing through the intersection.

The configuration described above may be implemented by a CPU or memory of any given computer, an LSI, or the like in terms of hardware, and by a memory-loaded program or the like in terms of software. In the present embodiment is shown a functional block configuration realized by cooperation thereof. Therefore, it would be understood by those skilled in the art that these functional blocks may be implemented in a variety of forms by hardware only, software only, or a combination thereof.

Figure 5:
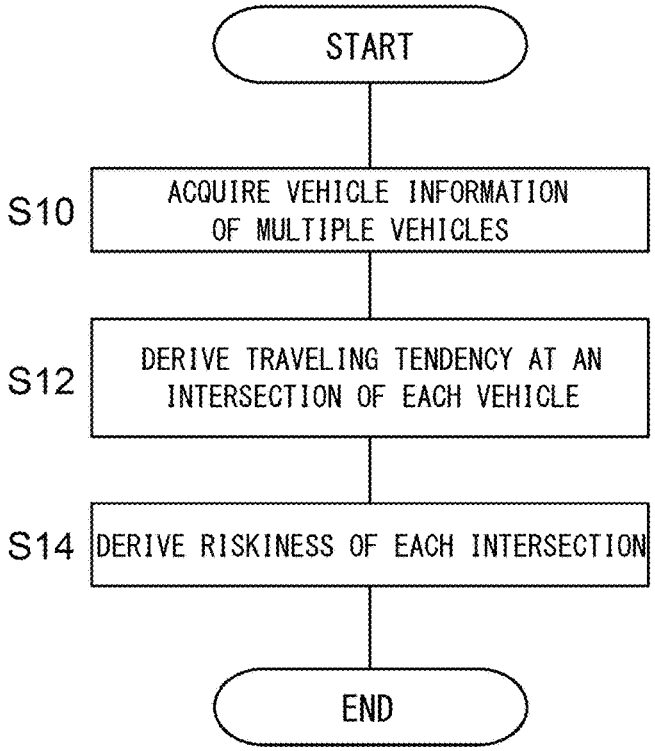
FIG. 5 is a flowchart that shows vehicle information processing performed by the server device shown in FIG. 1.

There will now be described the overall operation performed by the vehicle system 1 having the configuration set forth above. FIG. 5 is a flowchart that shows vehicle information processing performed by the server device 12 shown in FIG. 1. The processing shown in FIG. 5 is regularly repeated. The server device 12 acquires vehicle information of multiple vehicles 14 (S10), derives the traveling tendency at an intersection of each vehicle 14 (S12), and derives the riskiness of each intersection (S14).

Figure 6:
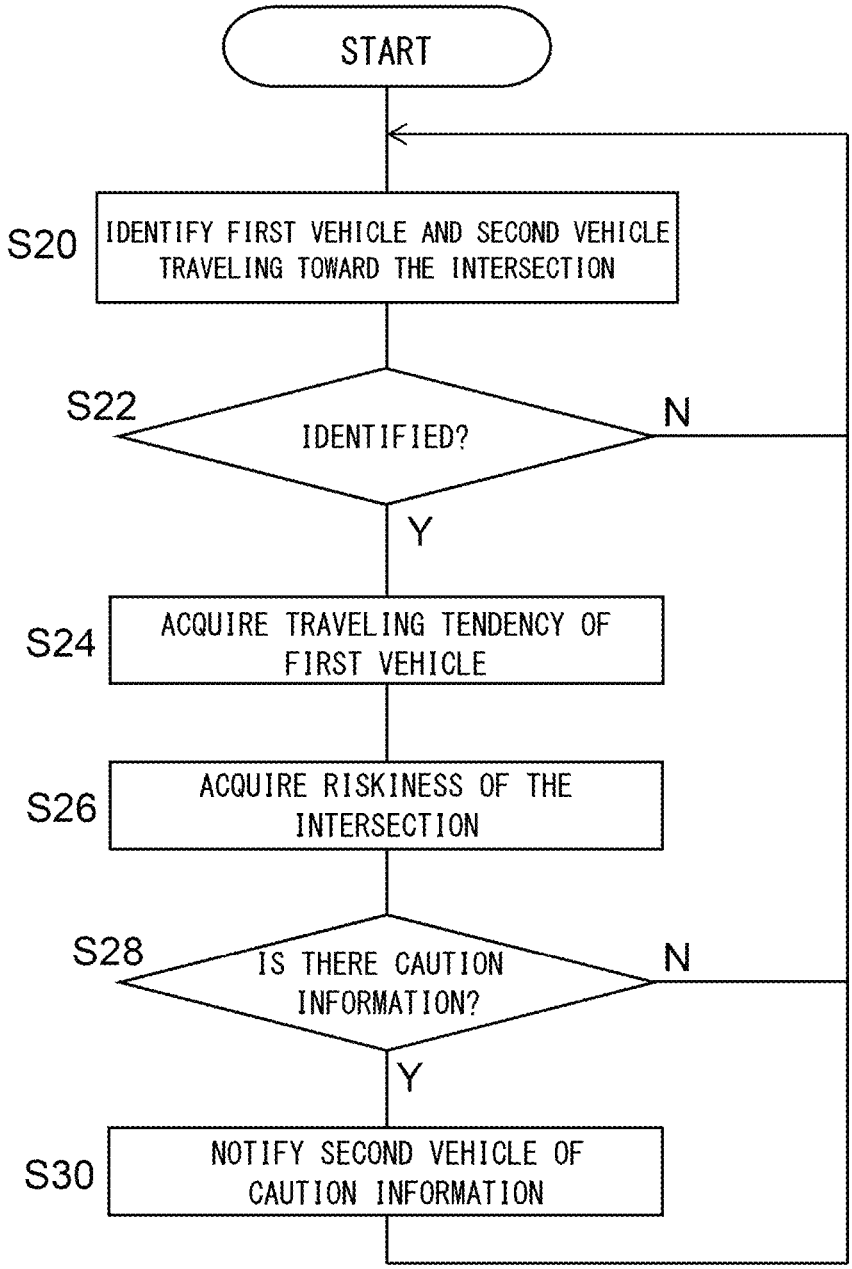
FIG. 6 is a flowchart that shows processing for intersection monitoring performed by the server device shown in FIG. 1.

FIG. 6 is a flowchart that shows processing for intersection monitoring performed by the server device 12 shown in FIG. 1. An intersection monitoring unit 44 identifies a first vehicle 14*a* and a second vehicle 14*b* traveling toward a predetermined intersection 100 (S20) and, when the first vehicle 14*a* and the second vehicle 14*b* cannot be identified (N at S22), the process returns to the step 20. When the first vehicle 14*a* and the second vehicle 14*b* can be identified (Y at S22), the intersection monitoring unit 44 acquires the traveling tendency of the first vehicle 14*a* (S24) and also acquires the riskiness of the intersection 100 (S26). When there is caution information (Y at S28), the intersection monitoring unit 44 notifies the second vehicle 14*b* of the caution information (S30), and the process returns to the step 20. When there is no caution information (N at S28), the process returns to the step 20. The processing shown in FIG. 6 is also performed by each of the multiple intersection monitoring units 44 monitoring other intersections.

According to the present embodiment, in the server device 12, the first storage unit 40 stores the traveling tendency at an intersection of each of multiple vehicles 14, and the second storage unit 42 stores the riskiness of each of multiple intersections. When the first vehicle 14*a* is traveling on the first road R1 toward the intersection 100 and the second vehicle 14*b* is traveling on the second road R2 toward the intersection 100, the traveling tendency of the first vehicle 14*a* is acquired from the first storage unit 40, and the riskiness of the intersection 100 is acquired from the second storage unit 42. Based on the traveling tendency of the first vehicle 14*a* and the riskiness of the intersection 100, whether or not there is caution information at the time of passing through the intersection is judged, and, when there is, the second vehicle 14*b* is notified of the caution information at the time of passing through the intersection. Therefore, at an arbitrary intersection, accurate caution information at the time of passing through the intersection can be conveyed in consideration of the features of the first vehicle 14*a* and the intersection.

Also, since the server device 12 collects vehicle information of multiple vehicles 14 and derives the traveling tendency at an intersection of each vehicle 14 and the riskiness of each intersection based on the vehicle information, the driver can be notified of accurate caution information at the time of passing through the intersection based on the vehicle information of the multiple vehicles 14.

Also, since the riskiness at the time of entering the intersection is judged, the driver can find how much attention to pay. Further, since the riskiness at the time of entering the intersection is judged to be higher when the traveling tendency of the first vehicle 14*a* indicates a tendency to contravene the traffic regulations, and the riskiness at the time of entering the intersection is also judged to be higher when the riskiness of the intersection 100 is higher, the riskiness at the time of entering the intersection can be appropriately judged.

Second Embodiment

The second embodiment differs from the first embodiment in that part of the processing in the server device 12 is performed by the vehicle-mounted device 10. In the following, description will be given mainly for the differences from the first embodiment.

Figure 7:
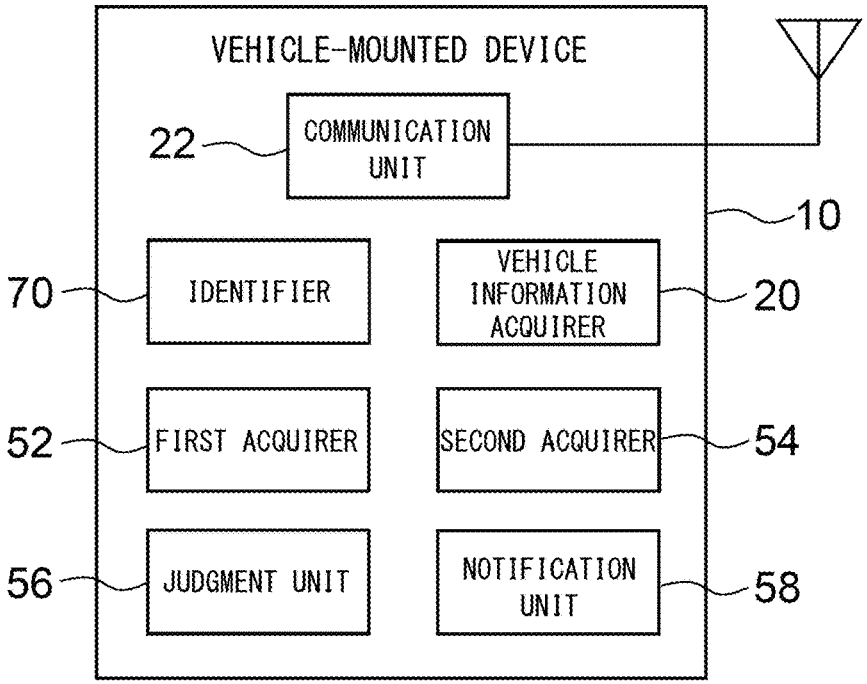
FIG. 7 is a block diagram that shows a configuration of a vehicle-mounted device according to a second embodiment.

FIG. 7 is a block diagram that shows a configuration of the vehicle-mounted device 10 according to the second embodiment. The vehicle-mounted device 10 functions as an information processor. The vehicle-mounted device 10 comprises the vehicle information acquirer 20, the communication unit 22, an identifier 70, the first acquirer 52, the second acquirer 54, the judgment unit 56, and the notification unit 58.

Figure 8:
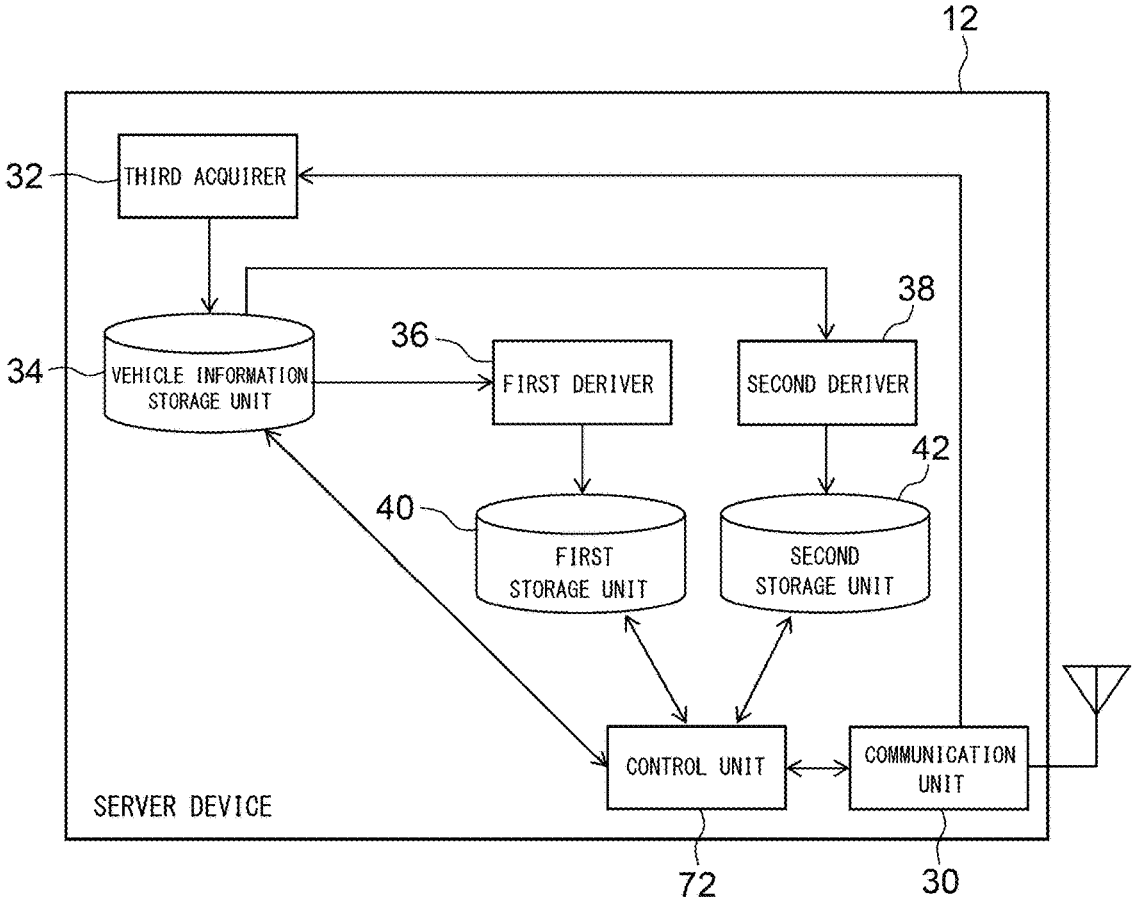
FIG. 8 is a block diagram that shows a configuration of a server device according to the second embodiment.

FIG. 8 is a block diagram that shows a configuration of the server device 12 according to the second embodiment. The server device 12 comprises the communication unit 30, the third acquirer 32, the vehicle information storage unit 34, the first deriver 36, the second deriver 38, the first storage unit 40, the second storage unit 42, and a control unit 72.

The second embodiment will also be described with reference to the situation of the intersection 100 shown in FIG. 4 as an example. In the vehicle-mounted device 10 of the second vehicle 14*b*, the identifier 70 identifies the second road R2 on which the subject vehicle is traveling, and the intersection 100 toward which the subject vehicle is traveling, based on the position information of the subject vehicle acquired by the vehicle information acquirer 20 and map data retained in a navigation system or the like, not illustrated, of the subject vehicle. The identifier 70 then outputs the information of the intersection 100 thus identified to the communication unit 22. The communication unit 22 transmits the information of the intersection 100 to the server device 12. The information of the intersection 100 includes latitude and longitude.

The communication unit 30 of the server device 12 receives the information of the intersection 100 transmitted from the vehicle-mounted device 10. The communication unit 30 then outputs the information of the intersection 100 to the control unit 72. Based on the information of the intersection 100 received by the communication unit 30, the control unit 72 acquires the current position information and the current bearing information of each vehicle present near the intersection 100 and outputs the current position information and current bearing information to the communication unit 30. The control unit 72 also acquires from the first storage unit 40 the traveling tendency of each vehicle present near the intersection 100 and outputs the traveling tendency to the communication unit 30. The control unit 72 also acquires from the second storage unit 42 the riskiness of the intersection 100 and outputs the riskiness to the communication unit 30. Accordingly, the communication unit 30 transmits, to the vehicle-mounted device 10 of the second vehicle 14*b*, the current position information, current bearing information, and traveling tendency of each vehicle present near the intersection 100, and the riskiness of the intersection 100, output by the control unit 72.

In the vehicle-mounted device 10 on the second vehicle 14*b*, the communication unit 22 receives the information as described above transmitted from the server device 12. Accordingly, the identifier 70 identifies the first vehicle 14*a* traveling on the first road R1 toward the intersection 100, based on the current position and the traveling direction of each vehicle present near the intersection 100 received by the communication unit 22.

When the first vehicle 14*a* is traveling on the first road R1 toward the intersection 100 and the second vehicle 14*b* is traveling on the second road R2 toward the intersection 100, the first acquirer 52 acquires the traveling tendency of the first vehicle 14*a* received by the communication unit 22. This process corresponds to the process by which the first acquirer 52 acquires the traveling tendency of the first vehicle 14*a* from the first storage unit 40 of the server device 12.

When the first vehicle 14*a* is traveling on the first road R1 toward the intersection 100 and the second vehicle 14*b* is traveling on the second road R2 toward the intersection 100, the second acquirer 54 acquires the riskiness of the intersection 100 received by the communication unit 22. This process corresponds to the process by which the second acquirer 54 acquires the riskiness of the intersection 100 from the second storage unit 42 of the server device 12.

The operation of the judgment unit 56 is the same as described in the first embodiment. When the judgment unit 56 has judged that there is caution information at the time of passing through the intersection, the notification unit 58 notifies the second vehicle 14*b*, or more specifically the driver of the second vehicle 14*b*, of the caution information at the time of passing through the intersection, before the second vehicle 14*b* enters the intersection 100. The notification unit 58 may be configured as a display unit that displays the caution information at the time of passing through the intersection in the form of text and images, as a speaker or the like that outputs the caution information at the time of passing through the intersection in the form of sound, or as a combination thereof.

According to the present embodiment, the effects of the first embodiment can be obtained and, in addition, the flexibility in the configuration of the vehicle system 1 can be improved.

Described above is an explanation based on exemplary embodiments. The embodiments are intended to be illustrative only, and it will be obvious to those skilled in the art that various modifications to a combination of constituting elements or processes could be developed and that such modifications also fall within the scope of the present disclosure.

For example, the judgment unit 56 may also judge whether or not there is a possibility of collision between the first vehicle 14*a* and the second vehicle 14*b*, based on the position and speed of the first vehicle 14*a* and the position and speed of the second vehicle 14*b*. For the judgment of the possibility of collision, well-known technologies can be employed. When the judgment unit 56 has judged that there is a possibility of collision and has also judged that there is caution information at the time of passing through the intersection, the notification unit 58 notifies the second vehicle 14*b* of the caution information at the time of passing through the intersection, before the second vehicle 14*b* enters the intersection 100. When the judgment unit 56 has judged that there is no possibility of collision, even though the judgment unit 56 has judged that there is caution information at the time of passing through the intersection, the notification unit 58 does not notify the second vehicle 14*b* of the caution information at the time of passing through the intersection. In this modification, since the notification of caution information is not performed when there is no possibility of collision between the first vehicle 14*a* and the second vehicle 14*b*, the caution information can be conveyed more appropriately in consideration of the traveling conditions of the first vehicle 14*a* and the second vehicle 14*b*.

The judgment unit 56 may also judge whether or not there is a possibility that the first vehicle 14*a* will stop at a stop instruction, based on the position, speed, brake operation information, and the likes of the first vehicle 14*a*. For example, when the first vehicle 14*a* is traveling before a stop instruction at a predetermined speed or less, with which a vehicle can stop at the stop instruction, and the first vehicle 14*a* also performs brake operation, the judgment unit 56 may judge that there is a possibility that the first vehicle 14*a* will stop. On the other hand, when the first vehicle 14*a* is traveling before the stop instruction at a speed higher than the predetermined speed, with which a vehicle cannot stop at the stop instruction, or when the first vehicle 14*a* does not perform brake operation before the stop instruction, the judgment unit 56 may judge that there is no possibility that the first vehicle 14*a* will stop. Accordingly, when the judgment unit 56 has judged that there is no possibility that the first vehicle 14*a* will stop, and the judgment unit 56 has also judged that there is caution information at the time of passing through the intersection, the notification unit 58 notifies the second vehicle 14*b* of the caution information at the time of passing through the intersection, before the second vehicle 14*b* enters the intersection 100. On the other hand, when the judgment unit 56 has judged that there is a possibility that the first vehicle 14*a* will stop, even though the judgment unit 56 has judged that there is caution information at the time of passing through the intersection, the notification unit 58 does not notify the second vehicle 14*b* of the caution information at the time of passing through the intersection. In this modification, the notification of caution information is not performed when there is a possibility that the first vehicle 14*a* will stop, even though the traveling tendency of the first vehicle 14*a* indicates a tendency to contravene the traffic regulations or even though the riskiness of the intersection 100 is high, so that the caution information can be conveyed more appropriately in consideration of the traveling conditions of the first vehicle 14*a*.

What is claimed is:

1. An information processor, comprising:

a first processor configured to acquire, when a first vehicle is traveling on a first road toward an intersection and a second vehicle is traveling on a second road, which intersects the first road, toward the intersection, a traveling tendency of the first vehicle from a first storage unit storing the traveling tendency at an intersection of each of a plurality of vehicles, wherein the first storage unit is configured to store the traveling tendency at an intersection of each of a plurality of vehicles in advance of the first processor acquiring the traveling tendency of the first vehicle;

a second processor configured to acquire, when the first vehicle is traveling on the first road toward the intersection and the second vehicle is traveling on the second road toward the intersection, riskiness of the intersection from a second storage unit storing the riskiness of each of a plurality of intersections, wherein the second storage unit is configured to store the riskiness of each of a plurality of intersections in advance of the second processor acquiring the riskiness of the intersection;

a fourth processor configured to judge whether or not there is caution information at a time of passing through the intersection, based on the traveling tendency of the first vehicle acquired by the first processor and the riskiness of the intersection acquired by the second processor; and a transmitter configured to transmit a signal, when the fourth processor has judged that there is caution information at the time of passing through the intersection, to the second vehicle, wherein the signal includes the caution information, and the transmitter is configured to transmit the signal before the second vehicle enters the intersection.

2. The information processor of claim 1, further comprising:

a third processor configured to acquire vehicle information at the time of entering an intersection of each of a plurality of vehicles;

a first deriver configured to derive the traveling tendency at an intersection of each vehicle based on the vehicle information of each of a plurality of vehicles acquired by the third processor and to store the traveling tendency thus derived in the first storage unit; and a second deriver configured to derive the riskiness of each intersection based on the vehicle information of each of a plurality of vehicles acquired by the third processor and to store the riskiness thus derived in the second storage unit.

3. The information processor of claim 1, wherein the fourth processor judges the riskiness at the time of entering the intersection, as the caution information at the time of passing through the intersection.

4. The information processor of claim 3, wherein, when the traveling tendency of the first vehicle indicates a tendency to contravene the traffic regulations, the fourth processor judges the riskiness at the time of entering the intersection to be higher, and, when the riskiness of the intersection is higher, the fourth processor also judges the riskiness at the time of entering the intersection to be higher.

5. The information processor of claim 1, wherein the first road is a road with a stop instruction, and the second road is a priority road.

6. A vehicle system, comprising:

a first storage unit storing a traveling tendency at an intersection of each of a plurality of vehicles;

a second storage unit storing riskiness of each of a plurality of intersections;

a first processor configured to acquire, when a first vehicle is traveling on a first road toward an intersection and a second vehicle is traveling on a second road, which intersects the first road, toward the intersection, the traveling tendency of the first vehicle from the first storage unit;

a second processor configured to acquire, when the first vehicle is traveling on the first road toward the intersection and the second vehicle is traveling on the second road toward the intersection, the riskiness of the intersection from the second storage unit;

a fourth processor configured to judge whether or not there is caution information at a time of passing through the intersection, based on the traveling tendency of the first vehicle acquired by the first processor and the riskiness of the intersection acquired by the second processor; and a transmitter configured to transmit a signal, when the fourth processor has judged that there is caution information at the time of passing through the intersection, to the second vehicle, wherein the signal includes the caution information, and the transmitter is configured to transmit the signal before the second vehicle enters the intersection.

* * * * *